US007331458B2

(12) United States Patent
Scott

(10) Patent No.: US 7,331,458 B2
(45) **Date of Patent: *Feb. 19, 2008**

(54) CONTAINER FOR HOLDING LIVE PLANTS FOR DISPLAY AND SALE FOR A LONG DURATION

(75) Inventor: Walter Scott, 3504 W. 185th St., Torrance, CA (US) 90504

(73) Assignees: Walter Scott, Torrance, CA (US); Shareen King, Long Beach, CA (US)

( * ) Notice: Subject to any disclaimer, the term of this patent is extended or adjusted under 35 U.S.C. 154(b) by 113 days.

This patent is subject to a terminal disclaimer.

(21) Appl. No.: 11/220,827

(22) Filed: Sep. 6, 2005

(65) Prior Publication Data

US 2006/0027476 A1 Feb. 9, 2006

Related U.S. Application Data

(63) Continuation of application No. 10/644,105, filed on Aug. 15, 2003, now Pat. No. 6,968,948.

(51) Int. Cl.
*B65D 85/52* (2006.01)
*A01G 9/02* (2006.01)

(52) U.S. Cl. ..... 206/423; 47/84

(58) Field of Classification Search ..... 206/423, 206/806; 47/67, 69, 72, 84
See application file for complete search history.

(56) References Cited

U.S. PATENT DOCUMENTS 3,314,194 A 4/1967 Halleck
3,973,355 A 8/1976 McKenzie
4,071,064 A 1/1978 Saul
4,075,786 A 2/1978 Van Zyl
4,242,835 A 1/1981 Sorribes
4,662,107 A * 5/1987 Van Den Kieboom ..... 47/84
4,915,224 A 4/1990 Wulf et al.
5,794,550 A 8/1998 Chadwick
6,013,524 A 1/2000 Friars et al.
6,463,697 B2 10/2002 Weder
2003/0047474 A1 3/2003 Dahlson

OTHER PUBLICATIONS

Erisorb—improving soil water holding capacity, http://www.eridian-asia.com, Eridan Co., Ltd., Thailand (4 pages), May 31, 2000.
Safety Data Sheet for Erisorb and Eridan SA (2 pages), Sep. 27, 1994.
Broadleaf P4, http://www.broadleafp4.com (10 pages), 2000.

* cited by examiner

*Primary Examiner*—Bryon P. Gehman
(74) *Attorney, Agent, or Firm*—Orrick Herrington & Sutcliffe LLP

(57) ABSTRACT

A sealed container system for packaging and displaying a live plant for sale. The system has a subcontainer that is partially filled with a hydrogel, or has a divider lid that separates the hydrogel from the rest of the container system. A lid covers the subcontainer, where the lid has a tapered or elongate lumen to accommodate the plant roots while preventing the leakage of the hydrogel. The clear or transparent container, with the hydrogel, allows the container to operate as a miniature greenhouse allowing the plant to be displayed for an extended period of time without the need for interventional care by a human.

10 Claims, 5 Drawing Sheets

CONTAINER FOR HOLDING LIVE PLANTS FOR DISPLAY AND SALE FOR A LONG DURATION

CROSS-REFERENCE TO RELATED APPLICATIONS

This application is a continuation of U.S. patent application Ser. No. 10/644,105, filed Aug. 15, 2003, now U.S. Pat. No. 6,968,948, which and is incorporated herein by reference.

FIELD OF THE INVENTION

The field of the invention is containers for holding live plants for display and sale, and more particularly, closed-system containers for holding live plants for display and sale for a long duration.

BACKGROUND

Live plants adorn our homes, businesses and everyday surroundings. There are many types of plants, such as aquatic plants, meaning plants adapted for living in a fresh water aquarium. People who own aquariums with fish, crabs, and other aquatic life often purchase aquatic plants for their aquariums. Typically, consumers purchase aquatic plants at a store that sells aquariums and fish. Non-aquatic plants are sold at retail garden stores, where they usually sit on a shelf and require daily waterings by a human or machine. The journey that live plants take to reach these stores is long and life-threatening. Live plants require water and nutrients. These plants may travel thousands of miles, from faraway countries, on ships, trains and trucks and endure long durations of travel without interventional care. Such plants are generally transported in containers having water or soil. During packing, transportation, and unpacking, plants fall over, causing their precious water or soil to spill. Having a reduced water or soil supply puts the plant at risk of failing to survive the long journey. Once packed, no one checks the plants and refills their water supply. As a result, many plants perish before arriving at their final destination, the retail store.

Even those plants that survive the journey to the retail store must further endure a significant time sitting on a shelf at the store, until a consumer purchases the plant and places the plant in its normal aquatic or in-ground environment. Retail stores must either expend significant human resources to water the plants so as to take care of their investment, or charge a higher price to make up for those plants that cannot be sold. Because it is cheaper to purchase plants (as with any item) in bulk, the time during which the plant sits on a shelf as opposed to its normal environment is increased. If the retail store places its aquatic plants in an aquarium, the cost of such care is high because of the cost of the aquariums, water, lights and electricity.

Water-retaining hydrogels have been used in the prior art to enhance the hydration of the roots of live plants, where plants are planted in pots that contain hydrogel. Because the hydrogel retains water well, less water is required for plants that reside in pots containing hydrogel. Similarly, hydrogel may be added to the dirt in a hole in the ground before a plant is put into the hole. Such open systems are not effective in transporting and displaying a live plant for a long duration at a retail store, without requiring the need for interventional human care and watering.

Therefore, there is a need for a container system that can hold and transport a live plant without spilling a water and/or nutrient source and also display the live plant for sale for a long duration in a self-sustaining manner.

SUMMARY OF THE INVENTION

In the example embodiment, the improved container system comprises a body having a top and a base and defining a lumen, a water-retaining hydrogel to hydrate the roots of a live plant, and a lid including a tapered lumen, where the lumen becomes narrower as the lumen extends from the lid. The roots of the live plant extends through the tapered lumen and into the hydrogel. The tapered lumen acts to prevent the hydrogel from spilling out of the area around the roots. In this example embodiment, the body is closed so that air does not escape from the body lumen, thereby creating a greenhouse for the live plant.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. All illustrations are intended to convey concepts, where relative sizes, shapes and other detailed attributes may be illustrated schematically, rather than literally or precisely. Moreover, in the figures, like reference numerals designate corresponding parts throughout the different views. However, like parts do not always have like reference numerals.

DETAILED DESCRIPTION OF THE PREFERRED EMBODIMENTS

Figure 1:
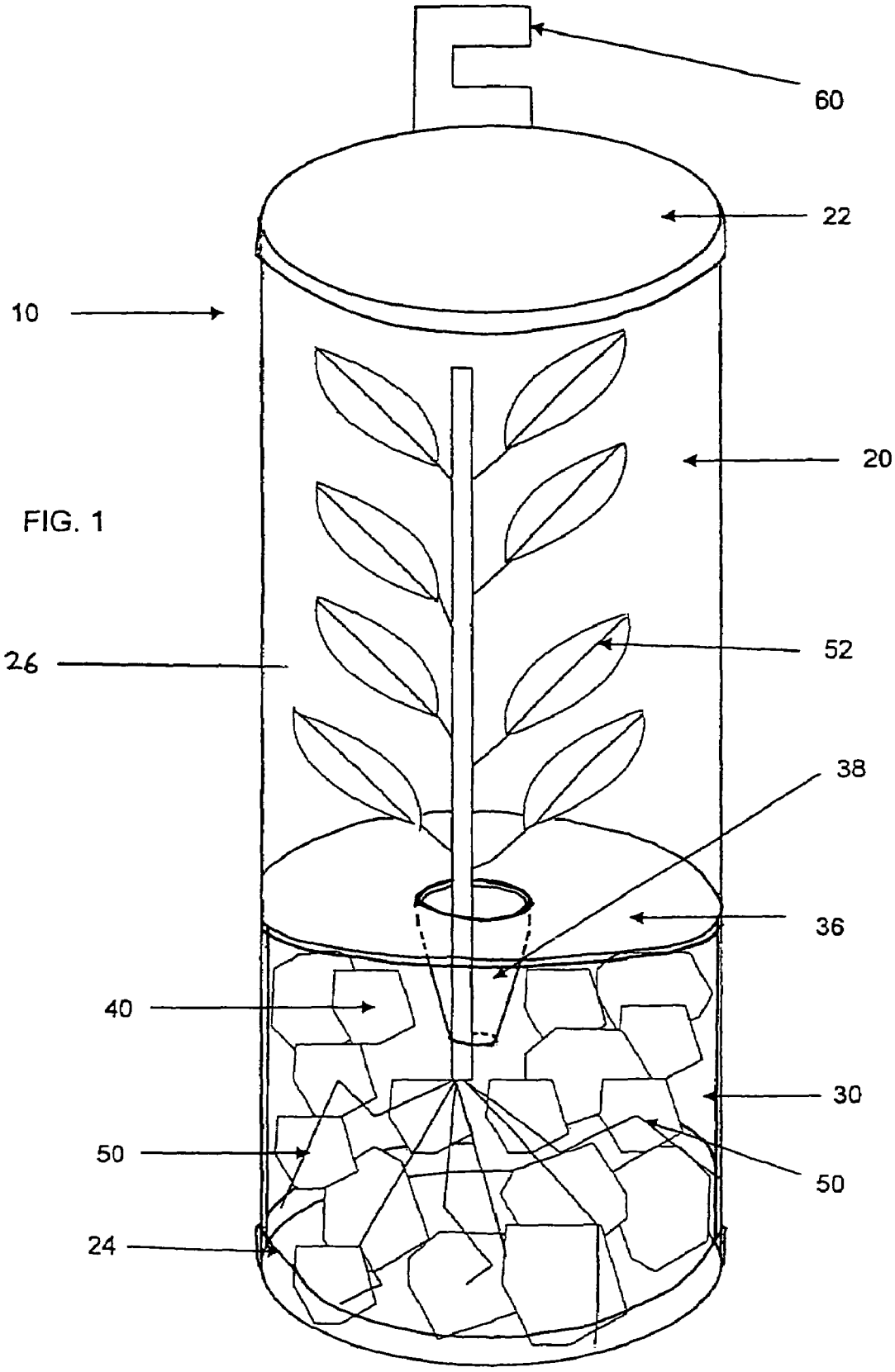
FIG. 1 is an illustration of an example embodiment of an improved live plant container system.
Figure 2:
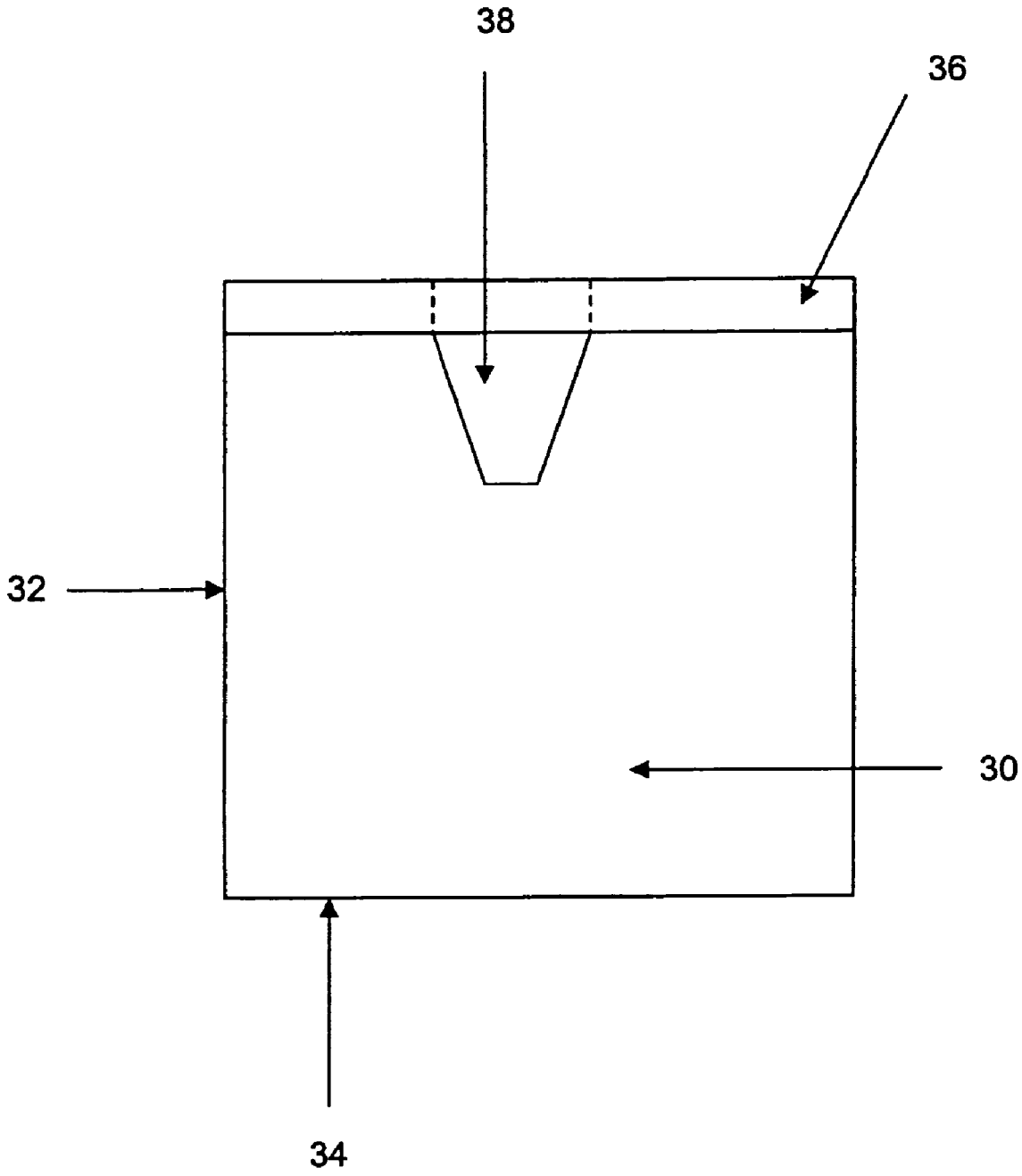
FIG. 2 is an illustration of a subcontainer in the improved live plant container system of FIG. 1.
Figure 3B:
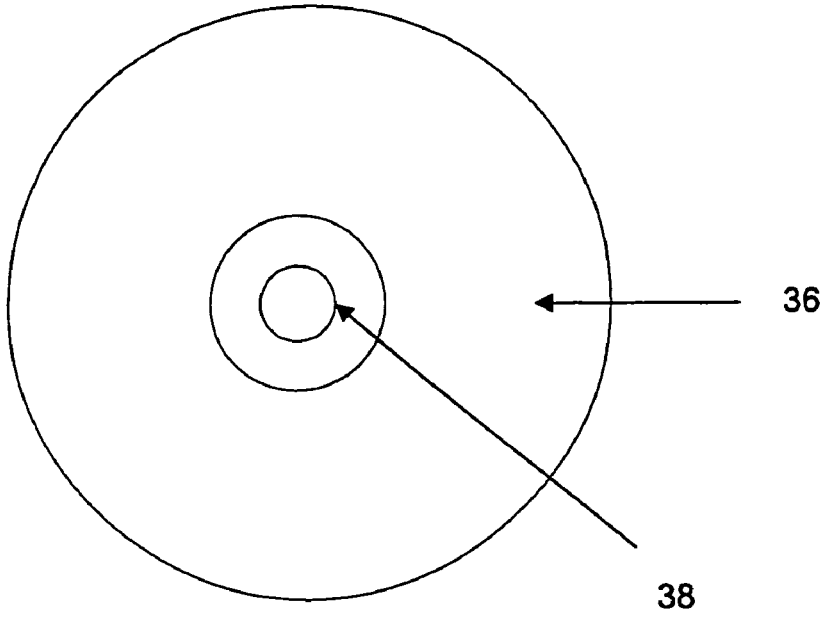
FIG. 3B is an illustration of the top view of the lid and tapered lumen of the subcontainer of the improved live plant container system of FIG. 2.
Figure 3A:
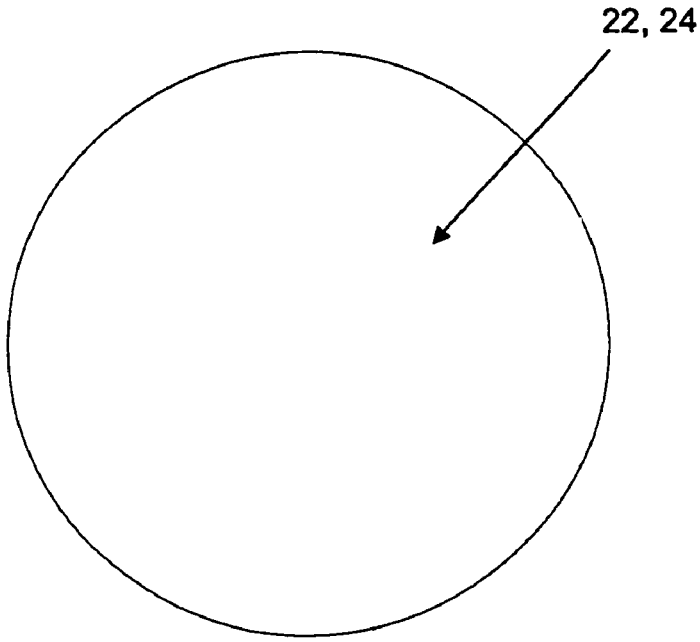
FIG. 3A is an illustration of a top view of the top 22 and/or base 24 of the improved live plant container system of FIG. 2.

In the example embodiment shown in FIG. 1, the improved container system 10 comprises a body 20 having a top 22 and a base 24 and defining a lumen 26 and a subcontainer 30. The top 22 and base 24 may be separate parts from the body 20, or one or both of the top and base may be integrally formed with the body 20. The optional card with a hook 60 will be explained later. As further shown in FIG. 2, the preferred embodiment of the subcontainer 30 has a subcontainer body 32, a bottom 34, and a lid 36. The subcontainer 30 preferably slides into the lumen 26 of the body 20 and rests on the base 24 of the body 20. The lid 36 of the subcontainer 30 includes a tapered lumen 38, where the lumen 38 becomes narrower as the lumen 38 extends away from the lid 36. The subcontainer 30 is adapted to contain a water-retaining hydrogel 40, or like material.

In the preferred embodiment, the hydrogel 40 is a superabsorbant polyacrylamide, such as Erisorb ES001, ES002, ES003 or ES004 sold by Eridan SA, 6 rue des Capucins, 69001 Lyon France. However, the hydrogel 40 may be other types of superabsorbant polymers or hydrogels. The hydrogel 40 made by Eridan comes in a powder or granular form. Water is added to the powder or granules to form clumps of hydrogel 40. The shape and size of the clumps may be varied. However, the size of the clumps should be generally larger than the diameter of the portion of the tapered lumen 38 furthest from the lid 36 and thus, closest to the hydrogel 40. Another source for a hydrogel is P4, a cross-linked copolymer polyacrylamide or a hydrophilic polymer, from Broadleaf Inc., whose internet website is www.broadleafp4.com. Still other hydrogels may be used.

The roots 50 of the live plant 52 are inserted through the tapered lumen 38 of the lid 36 of the subcontainer 30 and into the hydrogel 40. The lid 36 is then placed on the subcontainer 30 to close the subcontainer. The subcontainer 30 is then inserted into the lumen of the body 20 and the base 24 is attached to the body 20. Preferably, the subcontainer 30 rests on the base 24. Thus, after assembly, the plant's roots 50 reside in the hydrogel 40 within the subcontainer 30, while the leaves of the plant 52 reside in the lumen of the body 20 of the improved container system 10. The top 22 is placed on the body 20 to seal the body 20. Alternatively, the subcontainer 30 may be inserted into the lumen of the body 20 and slid down the lumen to rest on the base 24 of the body 20.

The body 20 is preferably made of a clear or transparent material so as to permit sunlight and artificial light to enter the container system 10. For instance, the parts of the improved container system 10 may be formed out of a plastic, polyurethane, polyethylene, glass, or another plastic. The parts of the container system, except the hydrogel, may be injection molded, blow molded, or vacuum molded out of a plastic, if desired.

As illustrated in FIGS. 1, 2, 3B, 4 and 5A-5D, an important feature of the improved container system 10 is the tapered lumen 38 of the lid 36. The tapered lumen 38 acts to prevent the hydrogel 40 from leaking out of the subcontainer 30. The tapered lumen 38 creates a vacuum within the subcontainer 30 that helps keep the hydrogel 40 in the subcontainer 30. The diameter of the tapered lumen 38 should be large enough to accommodate the roots 50 of the live plant 52 and allow for some growth, while preferably be small enough to prevent leakage of the hydrogel 40 out of the tapered lumen 38 of the subcontainer 30.

Figure 4:
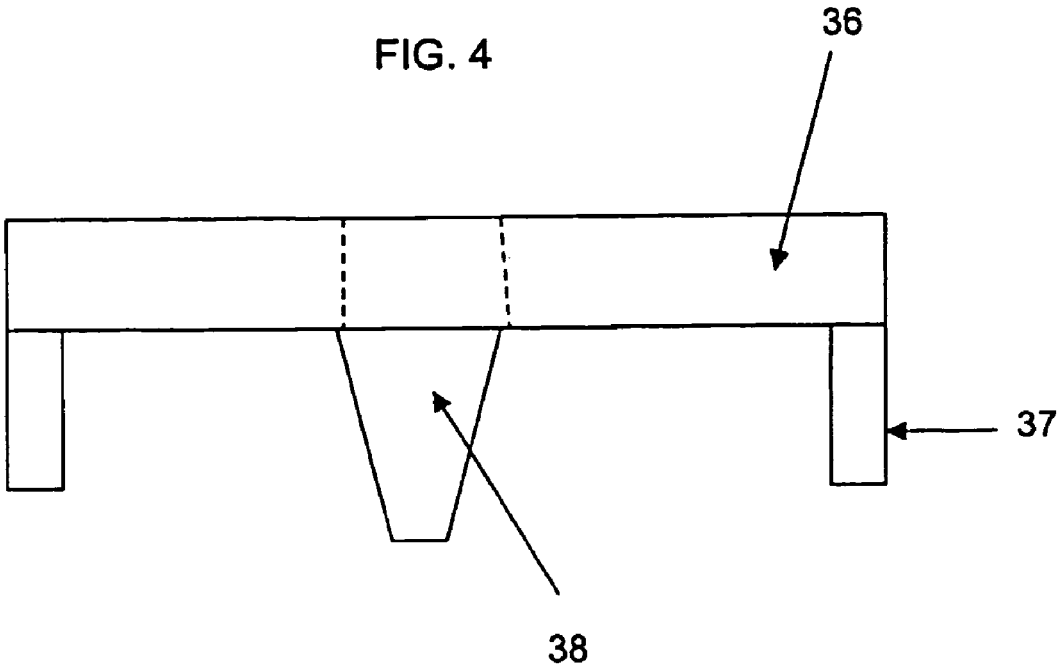
FIG. 4 is an illustration of a side edge view of the lid and tapered lumen of the subcontainer of the improved live plant container system of FIG. 2.

As shown in FIG. 4, the lid 36 preferably includes a lip 37. The lip 37 assists in securing the lid 36 to the rest of the subcontainer 30. In an embodiment that uses a lid 36 without the rest of the subcontainer 30, the lip 37 adds stability to prevent the lid 36 from pivoting relative to the base 24 when the lid 36 is inside the body 20.

Figure 5A:
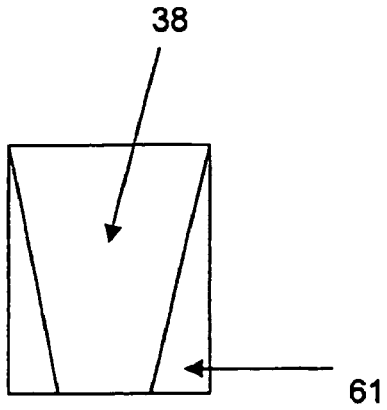
FIGS. 5A-5D are side view illustrations of example embodiments of a tapered lumen of the lid of the subcontainer of the improved live plant container system of FIG. 2.
Figure 5B:
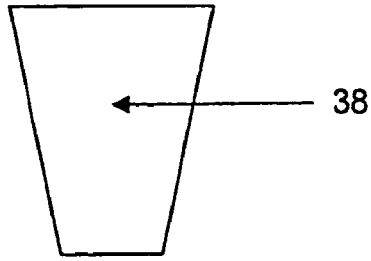
Figure 5C:
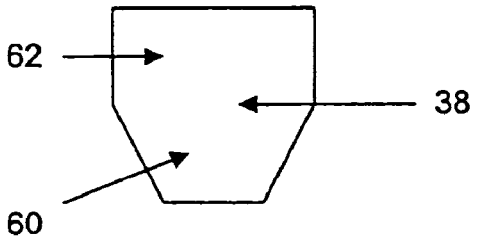
Figure 5D:
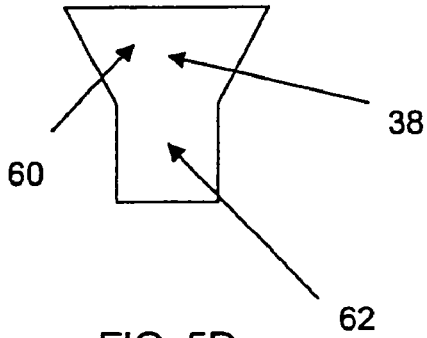

The shape and size of each of the above parts may be changed and adapted for the particular live plant to be housed in the improved container system 10. For example, the body 20 may be elongate if the plant 52 is elongate. Alternatively, the body 20 may be short and stout if the plant 52 is short and stout. Similarly, the shape and size of lumen 38 may be any shape and size that are appropriate for the live plant. For example, the lumen 38 may be a tapering cylindrical lumen, a tapering rectangular lumen, a tapering triangular lumen, or a tapering hexagonal lumen. The walls 61 of the tapering lumen 38 may be non-tapering such that the lumen 38 tapers internally as shown in FIG. 5A, or the walls of the tapering lumen 38 may be uniform so that the external surface of the walls also taper, as shown in FIG. 5B. Still alternatively, the tapering lumen 38 may have tapering portions 60 and non-tapering portions 62, examples of which are illustrated in FIGS. 5C and 5D.

The length of the lumen 38 may also be varied as desired, although the longer the lumen 38, the better the lumen 38 performs at preventing evaporation of water and leakage of the hydrogel 40. Experiments by the inventor show that evaporation of the water in the hydrogel 40 or leakage of the hydrogel 40 out of the subcontainer 30 shorten the duration a live plant can live in the container system 10. A tapering lumen 38 that is about ⅜ inch or ½ inch in length has been shown to work.

Figure 6:
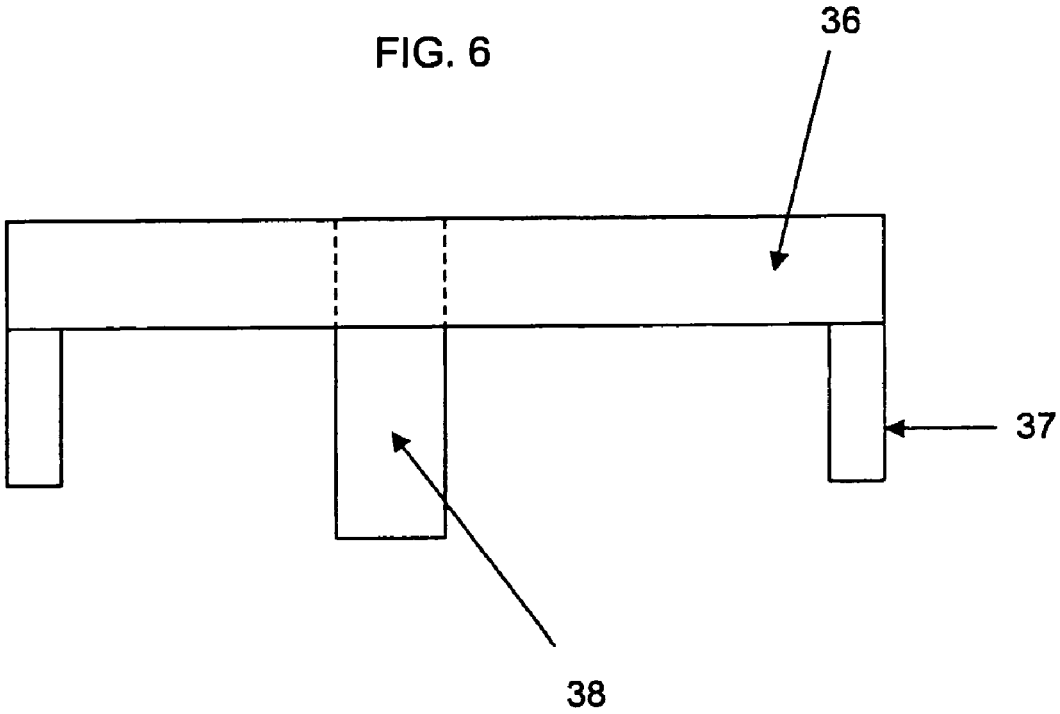
FIG. 6 is a side edge view of an alternative embodiment of a lid with a non-tapering lumen.

Alternatively to the tapered lumen 38, the lumen 38 may be an elongate non-tapering lumen, as shown in FIG. 6. If the lumen 38 is long and narrow enough, the lumen 38 may serve to provide the roots' access to the hydrogel 40, while preventing leakage of the hydrogel 40 and evaporation of the water in the hydrogel 40.

In the preferred example embodiment shown in FIG. 1, the body 20 is closed by the top 22 and base 24 so that air does not escape from the lumen of the body 20. Because air and moisture is trapped, a greenhouse environment is created for the live plant. After inserting the roots of a live plant through the tapered lumen 38 and into the hydrogel 40, moisture and nitrogen released by the plant remain in the container system, available for nourishing the plant. The improved container system 10 may be attached to a card with a hook 60, or just a hook 60, so that the container systems can be hung on a display for sale at a retail store. The card may include a product description and other advertisement.

Once planted in the improved container system, live plants may be transported easily, without spillage of the hydrogel and death of the plant. Moreover, the improved container system may be hung on a display at a retail store for a long duration without the death of the live plant. Live plants that have been planted in the improved container system may sit on the display in a store for many months without dying and without the need for extraneous and interventional care by humans or watering sprinklers. In a sense, the improved closed container system 10, with the presence of sunlight, provides a self-sustaining environment for a live plant. Retail stores no longer need to put aquatic plants in an aquarium, where they are eaten by fish and require electricity to maintain.

Although hydrogels have been used in the prior art to hydrate the roots of live plants, where plants are planted in pots of hydrogel or holes in the ground filled with hydrogel, these prior art systems are open systems, where there is no lid or tapered lumen or elongate lumen as in the improved closed container system 10. The purpose of the prior art systems is to enhance hydration of the plant's roots, not to enable transportation and display of a live plant for sale without maintenance.

Instead of requiring a separate subcontainer 30, another example embodiment of the improved container system 10 may simply use a divider 36 that fits snugly in the lumen of the body 20. In this embodiment, there is no subcontainer 30 and no bottom 34 of the subcontainer. Instead, the divider 36 has a tapered lumen 38, or an elongate lumen, and slides snugly into the lumen of the body 20 to separate the hydrogel 40 from the portion of the body that contains the leaves of the plant 52. Such a divider 36 may have a lip, rim, or other structure 37, as shown in FIGS. 4 and 6, that prevents the divider 36 from pivoting relative to the base 24 within the lumen of the body 20.

Optionally, plant food may be added to the hydrogel, especially if the live plant has special nutrient needs. Generally, however, the water-infused hydrogel is sufficient by itself to keep the live plant alive and growing. If plant food is desired, a preferred plant food for aquatic plants comprises, as macro elements, approximately: 20% nitrogen, 5% phosphorus, 16% potassium, 29% calcium, 5% magnesium and 24% sulfur. The micro elements comprise approximately: 0.066% boric, 0.132% manganese, 0.033% zinc, 0.033% copper, 0.33% ferrous, 0.00006% molybdenum, and 0.033% chlorine. Other types of plant food may be used, if desired.

In the foregoing specification, the invention has been described with reference to specific embodiments thereof. It will, however, be evident that various modifications and changes may be made thereto without departing from the broader spirit and scope of the invention. For example, the reader is to understand that the diagrams described herein are merely illustrative and that each feature of one embodiment can be mixed and matched with other features shown in other embodiments. Features and processes known to those of ordinary skill in the art of live plant containers may similarly be incorporated as desired. Additionally and obviously, features may be added or subtracted as desired. Accordingly, the invention is not to be restricted except in light of the attached claims and their equivalents.

What is claimed is:

1. A container for a live plant comprising:

a body defining a first lumen, the body having a base and a top to close the first lumen;

a water-retaining hydrogel;

a subcontainer adapted to slide within the first lumen of the body and to hold the hydrogel; and the subcontainer having a second lumen with a first end closest to the base and a second end further from the base, the second lumen extending in a direction from the first end toward the second end, the first end having a first opening and the second end having a second opening, the first opening being smaller than the second opening, the first opening being sufficiently narrow so as to provide access by the roots of the live plant to the hydrogel and prevent leakage of the hydrogel out of the subcontainer.

2. The container of claim 1 wherein the second lumen has a tapered portion.

3. The container of claim 1 wherein the second lumen has a non-tapered portion.

4. The container of claim 2 wherein the second lumen has a tapered portion.

5. The container of claim 1 further comprising a plant food added to the hydrogel.

6. The container of claim 1 wherein the first and second lumens are elongate.

7. The container of claim 2 wherein the tapered portion of the second lumen is cylindrical.

8. The container of claim 1 further comprising a live plant in the first lumen, wherein the roots of the plant protrude through the second lumen into a hydrogel in the subcontainer.

9. The container of claim 1 wherein the first opening has a smaller diameter than the second opening.

10. The container of claim 1 wherein the first opening has a smaller area than the second opening.

* * * * *